US005899098A

United States Patent [19]

Carter et al.

[11] Patent Number: 5,899,098

[45] Date of Patent: May 4, 1999

[54] TAMPER RESISTANT COMBINATION LOCK

[76] Inventors: Robert L. Carter, 3124 Brossman Ct., Naperville, Ill. 60564; George W. Carter, Jr., 5300 Walnut La., Colleyville, Tex. 76034

[21] Appl. No.: 08/853,941

[22] Filed: May 9, 1997

Related U.S. Application Data

[63] Continuation-in-part of application No. 08/584,459, Jan. 11, 1996, Pat. No. 5,640,860.

[51] Int. Cl.[6] ..... E05B 37/16

[52] U.S. Cl. ..... 70/25; 70/23; 70/68

[58] Field of Search ..... 70/25, DIG. 80, 70/64, 68, 23, 26

[56] References Cited

U.S. PATENT DOCUMENTS

| | | | |
|---|---|---|---|
| 603,711 | 5/1898 | Snyder | 70/25 |
| 1,387,750 | 8/1921 | Appleton | 70/25 |
| 1,401,030 | 12/1921 | Ashkar | 70/25 |
| 1,503,043 | 7/1924 | Greer | 70/25 |
| 1,686,632 | 10/1928 | Mayer | 70/25 |
| 1,759,283 | 5/1930 | Schmidt | 70/68 |
| 2,101,264 | 12/1937 | Mayer | 70/25 |
| 2,985,005 | 5/1961 | Kahn | 70/25 |
| 3,580,016 | 5/1971 | Kerr | 70/68 |
| 4,862,714 | 9/1989 | Taylor et al. | 70/25 |
| 4,866,958 | 9/1989 | Brett et al. | 70/25 |
| 4,952,228 | 8/1990 | Taylor et al. | 70/25 |
| 4,959,978 | 10/1990 | Cappell | 70/25 |

FOREIGN PATENT DOCUMENTS

| | | | |
|---|---|---|---|
| 26694 | 9/1920 | Denmark | 70/25 |
| 5160059 | 12/1990 | France | 70/25 |

*Primary Examiner*—Steven Meyers
*Assistant Examiner*—Teri Pham
*Attorney, Agent, or Firm*—Dillis V. Allen, Esq.

[57] ABSTRACT

A tamper resistant combination lock including a housing having a through bore receiving a locking plunger with a plurality of integral-spaced obstructions thereon, the housing having a plurality of transverse slots each receiving one of two identical blocking slides that snap between three distinct positions, one passing the obstructions and plunger, and two blocking the obstructions and plunger. Lock picking is minimized by flexible fingers in the slides that engage the plunger obstructions when the slides are in the plunger passing position to simulate the slide blocking positions as the lock picker tugs the plunger.

6 Claims, 5 Drawing Sheets

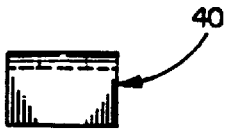
Fig. 14
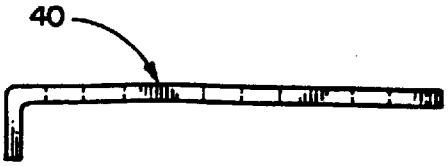
Fig. 15
Fig. 16
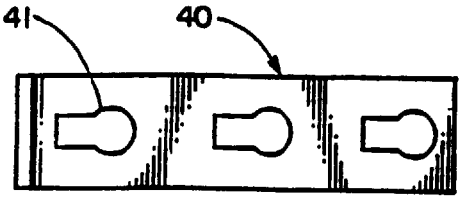
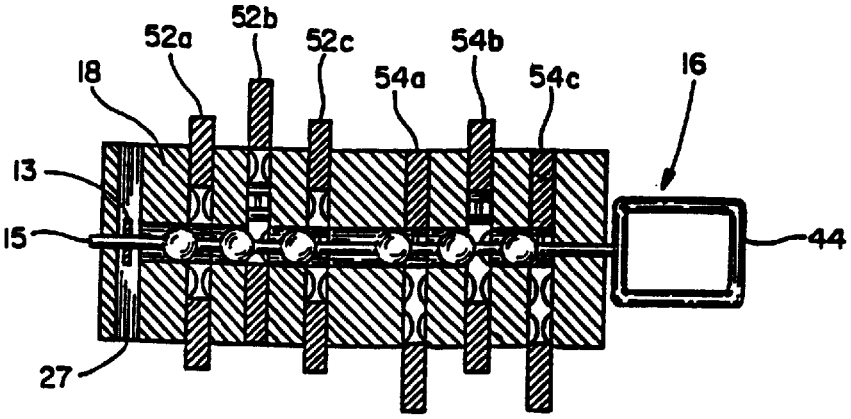
Fig. 17
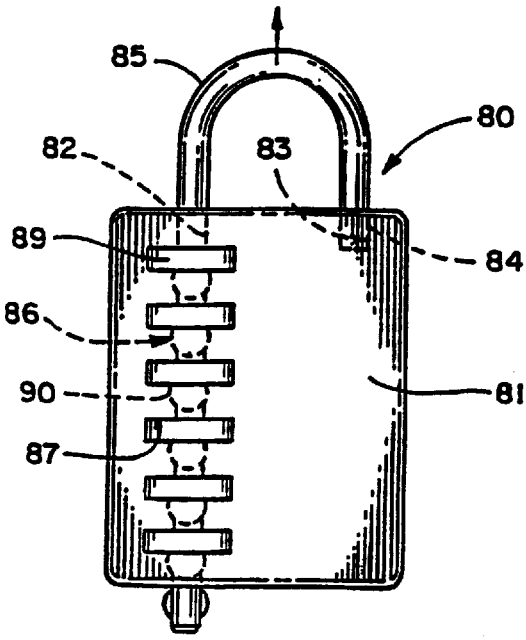
Fig. 18

TAMPER RESISTANT COMBINATION LOCK

RELATED APPLICATION

This application is a Continuation-In-Part of our U.S. patent application Ser. No. 08/584,459, filed Jan. 11, 1996, entitled "TAMPER RESISTANT COMBINATION LOCK", now U.S. Pat. No. 5,640,860.

BACKGROUND OF THE INVENTION

Combination locks have, of course, achieved considerable commercial success, but attempts to manufacture and market relatively inexpensive locks have been quite different largely because very inexpensive locks are fairly simple to pick. While the present lock is exemplified as an aftermarket combination lock for pistol cases, the lock has other low costs applications, and hence, the prior art is equally as broad.

A preliminary patentability search resulted in the following collection of U.S. Pat. Nos.: Enholm, 428,387; Battershell, 1,733,772; Legat, 1,898,974; Ponder, 2,740,530; Nemsky, 3,155,230; Esquibel, et al., 3,514,981; Feinberg, 3,597,945; Pedro, 3,865,166; Jones, Re. 30,139; Ippolito, et al., 4,187,703; Gordon, 4,463,847; Terada, et al., 5,081,855; Jarboe, 5,125,661; and Blanchard, 5,322,200.

The Ippolito, et al., U.S. Pat. No. 4,187,703, shows a locking system applied to an envelope defined by a pair of spaced plates, holding a numismatic coin. The Ippolito device has a slide plate 14 with cross slots 16 transversely positioned away from a central longitudinal slot 18. The transversely movable slides are all identical and can be positioned either in a right-hand or left-hand orientation as seen in FIG. 9. This arrangement, however, produces only two positions for each switch and, therefore, yields few combinations.

The Jarboe, U.S. Pat. No. 5,125,661, discloses a plunger-type locking mechanism, but there is really no logic in the lock combination because if all the plungers are depressed, the plunger 19 can be removed regardless of the position of blocks 35. Thus, it is not really a true combination lock at all.

The Esquibel, et al., U.S. Pat. No. 3,514,981, discloses a plunger-type locking mechanism for a box wherein a locking bar 14 is held or released by a plurality of slide bars 13 that have second slots 30 all positioned the same distance from the inner ends of the bars, and first slots 29 positioned in varying locations to correspond to one of the indicia on area 33 of the projecting ends of the bars 13. When the bars are slid to the appropriate indicia, the slots 29 permit the release of bars 14. The Esquibel, et al. lock has a total of only 48 combinations possible with five bars 13.

It is a primary object of the present invention to ameliorate the problems noted in the prior art above and provide a low cost combination lock that is considerably more tamper-proof than prior art constructions while at the same time having a greater number of possible combinations.

SUMMARY OF THE PRESENT INVENTION

According to the present invention, a low cost tamper resistant combination lock is provided that combines a high number of possible combinations with improved tamper resistance. Toward this end, the present lock includes a one piece molded plastic housing having a through bore that receives a one piece plastic plunger having a plurality of integral spherical obstructions. The housing has a plurality of transverse slots each receiving one of two identical blocking slides that snap between three distinct positions, one passing the spherical obstructions and two blocking the obstructions and plunger. Lock picking is minimized by integral flexible fingers in obstruction passing apertures in the slides that engage the spherical obstructions when the slides are in the plunger passing position to simulate the slide blocking positions as the lock picker tugs the plunger.

In the exemplary embodiment disclosed in this application, the housing has a plurality of rivet head shaped bottom projections that can pass through apertures in a flexible pistol case enabling the lock to be used to engage and lock the zipper tang of the case in its zipper closed position.

It should be understood, however, that the present tamper resistant lock can be utilized in other applications because of its low cost and tamper resistance.

The first of the two blocking slides is rectangular in configuration and has a central through bore that has a diameter slightly larger than the plunger's spherical obstructions and side slots extending laterally from the central aperture that receive the small diameter portions of the plunger between the spherical obstructions when this slide is in its two blocking positions on either side of the central aperture. Both sides of this blocking slide have side recesses aligned with the ends of the slot that receive the spherical plunger projections when in the blocking positions providing a snap action movement of the blocking slide between its three positions when tension is applied to the plunger.

This snap action not only facilitates the use of the blocking slides but also improves tamper resistance because the lock picker feels the same snap action when moving from the blocking position to the pass position or from the pass position to one of the blocking positions.

To further enhance tamper resistance, a plurality of integral tabs or spring fingers are formed in the central passing aperture in the slides, and they engage the spherical obstructions when the slide is in the passing position. Thus, if the lock picker tugs on the plunger when the slide is in its passing position(but still blocked by other blocking slides), the spherical obstruction will hit the spring fingers causing that particular slide to shift slightly in the slot in a longitudinal direction the same as the slides do when in the blocking position. In this way the lock picker cannot distinguish between the slight shifting movement of the slide in the blocking position and the slides in the passing position when he tugs longitudinally on the plunger.

The second blocking slide is similar to the first except that the passing aperture is in the side position and the slot is a lateral slot extending from the aperture through the central position to the opposite side position. This slide has the same spherical receiving recesses as the first blocking slide formed on both surfaces. This second slide can be reversed in the housing slots to provide both left-hand and right-hand passing thereby increasing the possible combinations without any additional cost.

Since the housing, the blocking slides and the plunger are all one piece plastic moldings, the resulting combination lock is quite inexpensive to manufacture.

According to another embodiment of the present invention, the slides have flexible fingers adjacent the passing position for the plunger that flex radially outwardly to permit the plunger obstructions to pass there-through. These slides are prevented from falling out of the lock body when the plunger is completely withdrawn by an integral leaf spring formed on the slides that engage one side of the housing slots. The lower side of the slides has three recesses that are selectively received in a projection or detent in the bottom of the slot to selectively hold the slide in one of its three positions.

According to a still further object of the present invention, the present lock housing is formed in upper and lower halves, with the lower half being formed integrally with a hard plastic case providing an extremely low-cost lock and case assembly.

Other objects and advantages of the present invention will appear more clearly from the following detailed description of the preferred embodiment.

BRIEF DESCRIPTION OF THE PREFERRED EMBODIMENT

FIG. 14 is an end view of the L-shaped housing slide connector;

FIG. 15 is a side view of the connector illustrated in FIG. 14;

FIG. 16 is a bottom view of the connector illustrated in FIGS. 14 and 15;

FIG. 17 is a longitudinal section of the present tamper resistant lock with all six blocking slides shown in various positions;

FIG. 18 is an alternative form of the present tamper resistant lock shown and exemplified in a padlock-type lock;

DETAILED DESCRIPTION OF THE PREFERRED EMBODIMENT

Figure 1:
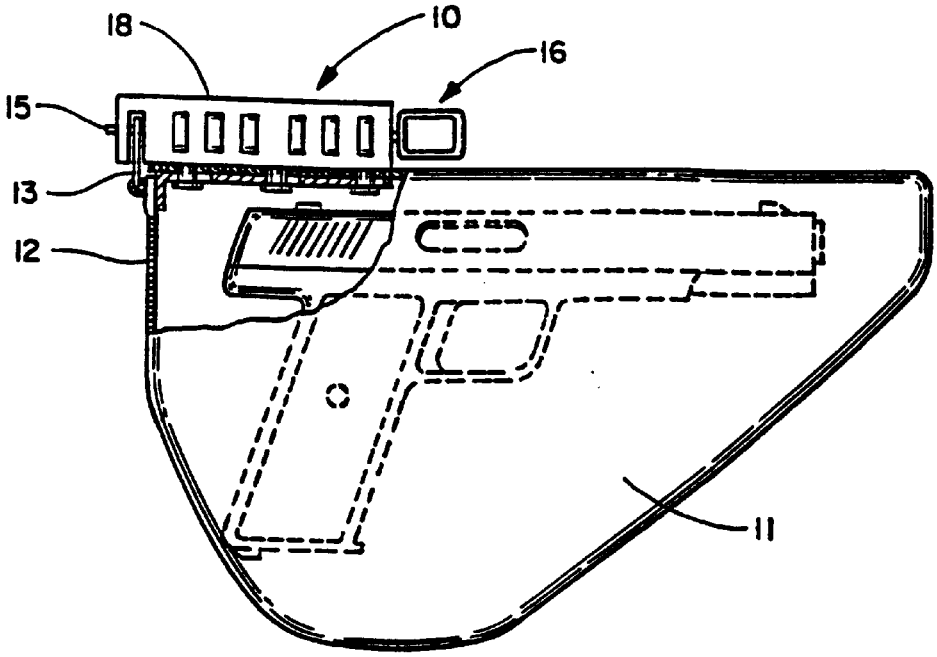
FIG. 1 is a side view of a flexible pistol case with the present tamper resistant combination lock fastened to its upper surface holding its zipper tang in a locked position with part of the fabric broken away near the lock mounting.
Figure 2:
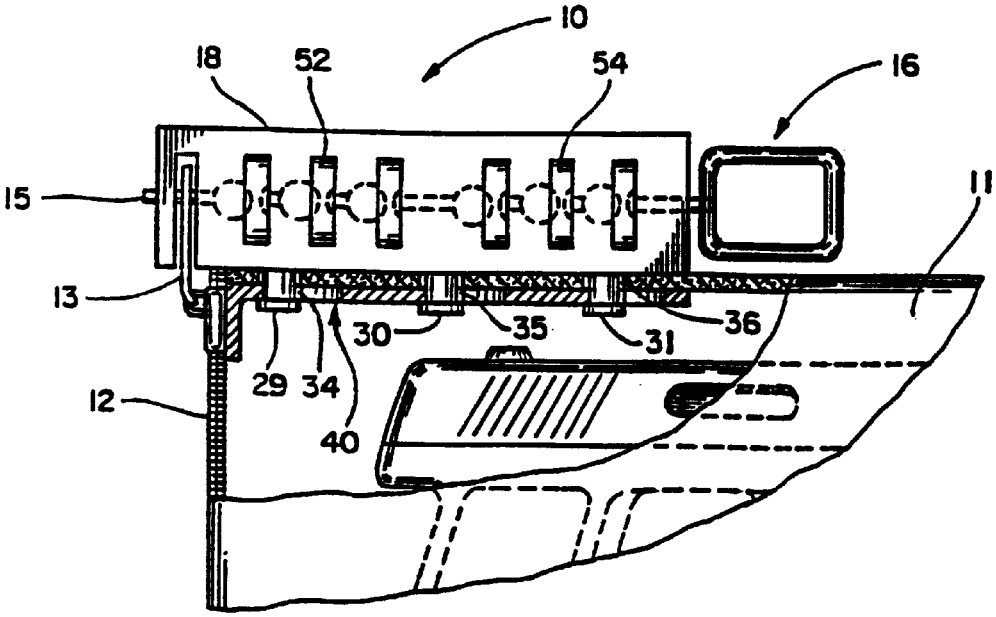
FIG. 2 is an enlarged fragmentary view of FIG. 1 showing the present tamper resistant combination lock and illustrating its manner of connection to the pistol case.

Referring to the drawings and particularly FIGS. 1 and 2, the present tamper resistant combination lock assembly 10 is illustrated attached to a flexible pistol case 11 having a peripheral zipper 12 and a pivotal zipper tang 13 having a conventional aperture there-through held in a locked position by distal end 15 of a locking plunger 16 forming part of the combination lock 10.

As seen in FIGS. 3, 4, and 11 to 13, the lock housing 18 is seen to be generally rectangular in configuration and may be constructed of a one piece plastic molding. A central bore 20 extends longitudinally through the housing and it is intersected by six blocking slide receiving transverse slots 21, 22, 23, 24, 25 and 26. Note the configuration of the slots and bore shown in fragmentary form in FIG. 4. An additional end slot 27 is provided for receiving zipper tang 13.

Figure 11:
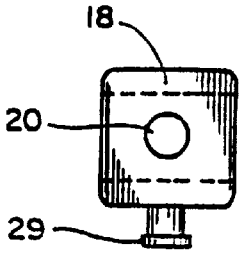
FIG. 11 is an end view of the lock housing.
Figure 12:
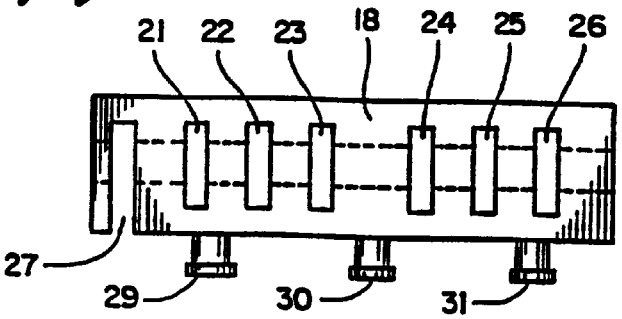
FIG. 12 is a side view of the lock housing.
Figure 13:
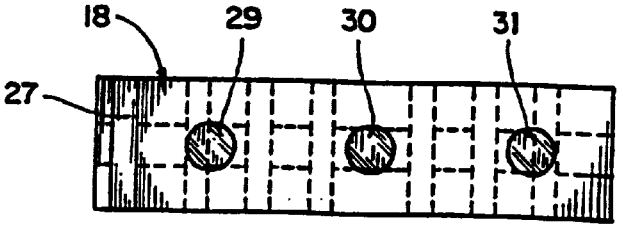
FIG. 13 is a bottom view of the lock housing.

As seen in FIGS. 11 and 12, the housing has three integral headed projections 29, 30, 31 extending downwardly therefrom that are designed to pass through apertures 34, 35 and 36 in the top wall of the pistol case 11. A key-hole type L-shaped connector 40 illustrated clearly in FIGS. 14, 15 and 16 has three key-hole type apertures 41 that receive the headed projections 29, 30 and 31 to lock the housing 18 and the lock 10 to the pistol case 11 in its appropriate position.

Figure 9:
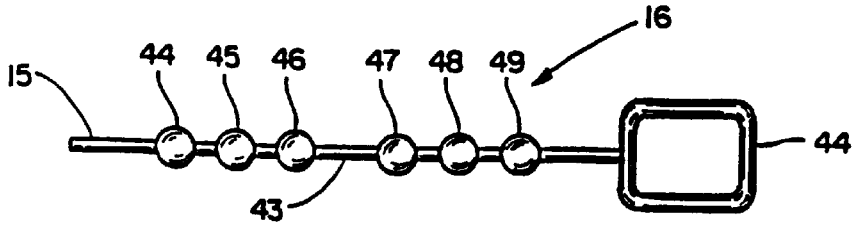
FIG. 9 is a sub-assembly view of the locking plunger.
Figure 10:
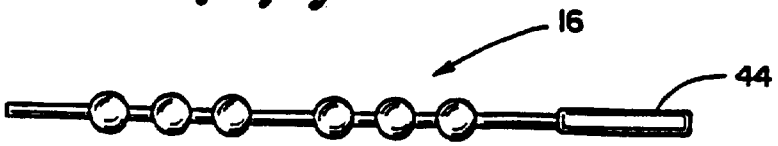
FIG. 10 is an orthogonally rotated view of the locking plunger illustrated in FIG. 9.

As seen in FIGS. 9 and 10, plunger 16, which can be easily constructed of a one piece plastic molding, includes a rod portion 43 having a finger loop 44 at one end and six integral spherical obstructions 44, 45, 46, 47, 48 and 49.

Figure 3:
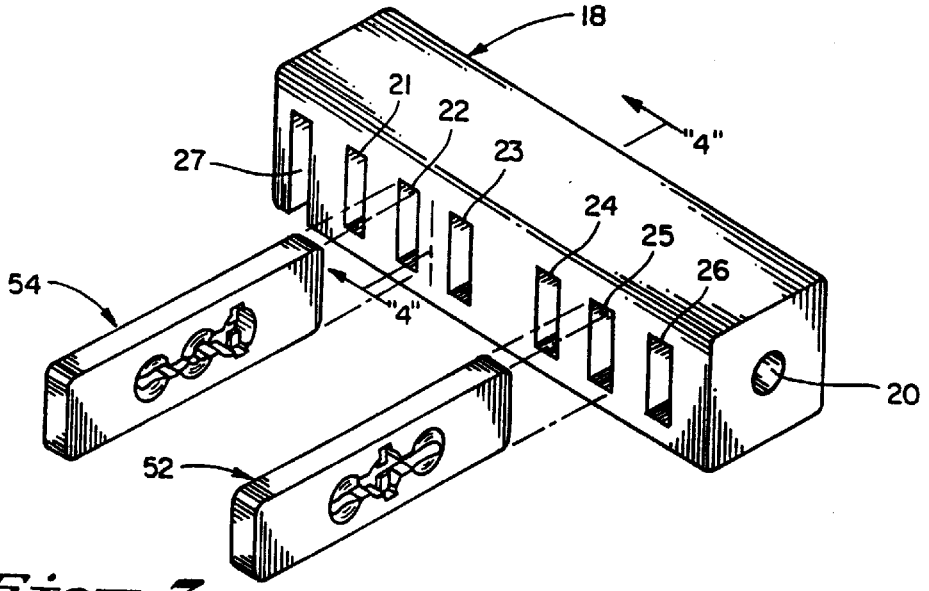
FIG. 3 is an exploded perspective illustrating the one piece lock housing with one of each of the two standard blocking slides.
Figure 4:
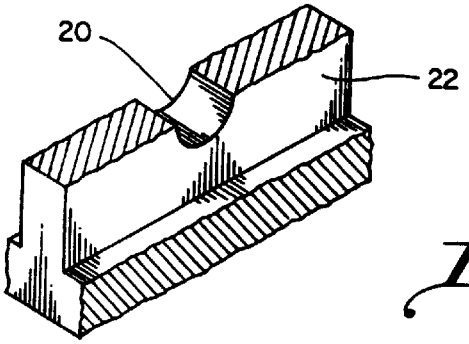
FIG. 4 is a fragmentary section of the housing taken generally along line 4—4 of FIG. 3.
Figure 5:
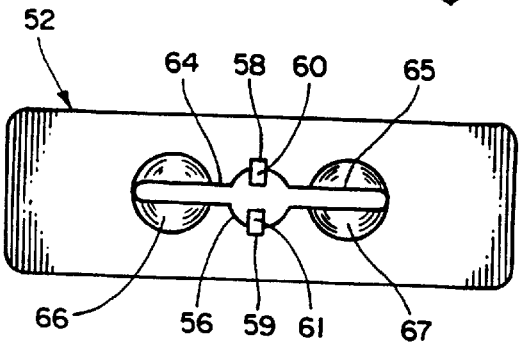
FIG. 5 is a side view of one of the standard blocking slides.
Figure 6:
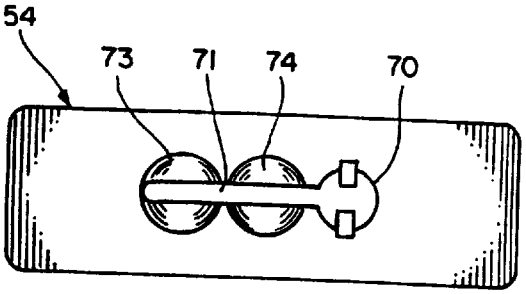
FIG. 6 is a side view of the other standard blocking slide.

Two standard blocking slides 52 and 54 are illustrated respectively in FIGS. 5 and 6 (as well as FIG. 3). It should be understood that of the six slides in the exemplary embodiment illustrated, three take the form of slide 52 and three take the form of slide 54.

It should be understood as seen in FIGS. 3, 5 and 6, that the slides 52 and 54 are rectangular in configuration and identically configured on both sides of each so that the slides 52, 54 are reversible in slots 21 to 26.

Figure 7:
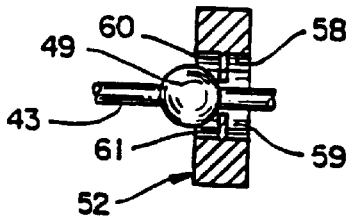
FIG. 7 is a cross section through one of the blocking slides taken through the passing aperture showing the spring finger positions.
Figure 8:
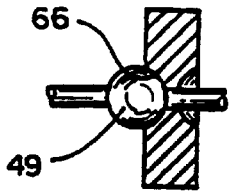
FIG. 8 is a cross section through the blocking slide in one of the blocking positions.

Each of the slides is a one piece rectangular plastic molding, and slide 52 includes a central through aperture 56 having a diameter slightly larger than spherical obstructions 44 to 49. Aperture 56 has upper and lower key-type slots 58 and 59 that have molded therein integral spring fingers 60 and 61 shown also in FIG. 7. The spherical projection 49 in FIG. 7 is illustrated in the lock position of the plunger, and in this position the spring fingers 60 and 61 engage one side of the obstruction 49. As a would-be lock picker pulls outwardly on plunger loop 44, obstruction 49, because of its engagement with spring fingers 60 and 61, shifts the slide very slightly laterally in its slot the same way the obstruction would shift the slide when in its blocking position illustrated in FIG. 8. In this way, regardless of whether the slide is in its blocking position or in its passing position, when the plunger is pulled axially, each of the slides will shift in their respective slots making it impossible for the lock picker to distinguish between slides in the locking position and slides in the blocking position.

However, fingers 60 and 61 are sufficiently flexible so they fold down in their adjacent recesses when plunger 16 is pulled with all the slides in the obstruction passing position, permitting the distal end 15 of the plunger to release tang 13.

Returning to FIG. 5, slide 52 has a pair of transverse slots 64 and 65 having a height somewhat greater than the rod portions 43 of the plunger that receive the rod portion in the two blocking positions of slide 52. The slide 52 has side recesses 66 and 67 at the ends of the slots (on both sides of the slides) that receive the spherical plunger projections when the slide is in its blocking position that provide the snap action movement of the slides when force is applied to the plunger (see FIGS. 8 and 17 for exemplary illustrations of the spherical projections when in the blocking recesses).

The blocking slide 54 has the same outer geometry as the slide 52 but rather than a central aperture has a side aperture 70 that passes projections 44 to 49 and a lateral slot 71 that passes plunger portion 43 and extends through the central position of the slide and the other side position. Recesses 73 and 74 are provided on both sides of the slide aligned with the two blocking positions of the slide and are identical in geometry to recesses 66 and 67 in slide 52.

Because both sides of slide 54 are identical, this slide can be reversed in the slots 21 to 26 to effect either right side blocking or left side blocking as desired thereby increasing the possible combinations of the lock without requiring the tooling for a third slide.

As seen in FIG. 17, plunger 44 is in its locked position and in this position the spherical projections 44 to 49 are either partly in one of the passing apertures 56 in slides 52 or 70 in slides 54, or in one of the blocking recesses 66, 67, 73, 74. The position of the loop 44 close to housing 18 holds the spherical projections 44 to 49 in either the blocking recesses or through apertures in the slides. However, there is still a small amount of play there-between.

In use, and in reference particularly to FIG. 17, assume that each of the blocking sides 52*a*, 52*b*, 52*c*, 54*a*, 54*b*, and 54*c* are in their plunger passing positions and that plunger 16 is partly withdrawn with its distal end 15 short of end slot 27. Gun case zipper 12 is then closed and its tang 13 positioned as shown, then plunger 44 is shifted to the left impaling the aperture in the zipper tang and moving the plunger to its locking position illustrated in FIG. 17.

Slides 52 and 54 are then all shifted away from the passing positions to one of the two blocking positions of each. Unlocking is, of course, effected by shifting each of the slides from one's memory or notes to its passing position. Because each of the blocking slides has only three positions and these positions are distinct, it is relatively easy to memorize the lock combination and also relatively easy for the lock user to unlock the lock from memory simply by "feeling" the position of the slides even in the dark.

The lock combination can be changed by either switching one or more slides 52 with one or more slides 54 or by rotating one or more slides 54 180 degrees in its slot as noted above.

FIG. 18 illustrates an alternative form of the present invention and is exemplified as a combination padlock, and is seen to include a rectangular padlock housing 80 having a main bore 82 there-through and a secondary bore 83 extending partly there-through that receives a distal end 84 of a U-shaped portion 85 of plunger 86. The housing 81 has a plurality of transverse slots 87 there-through that receive a plurality of blocking slides 89 that effect selective blocking of spherical obstructions 90 formed on the plunger 86.

The portion of the plunger 86 slidable in main passage 82 is identical to the corresponding portion of plunger 16 in the FIGS. 1 to 17 embodiment and blocking slides 89 are identical to blocking slides 52 and 54 also illustrated with respect to the FIG. 17 embodiment. The plunger 86 and U-shaped portion 85 are rotatable in housing main passage 82 to effect the desired swiveling motion in a padlock and, of course, the symmetrical shape of the plunger portion in bore 82 and the spheroidal configuration of obstructions 90 conveniently accommodate the desired pivotal, as well as reciprocal, motion of U-shaped plunger portion 85 as distal end 84 moves in and out of secondary passage 83 and swivels toward and away from the lock body 81.

Referring to FIGS. 19 to 22, which illustrate an alternative embodiment 110 of the present tamper resistant lock assembly, it should be understood that this lock operates in substantially the same manner as the lock illustrated in FIGS. 1 to 17, as well as the lock illustrated in FIG. 18, in the drawings. Lock assembly 110 includes a block-like housing 111 consisting of a lower housing half 112 and an upper housing half 113, that are locked together by inter-engaging projections 116 that in upper housing half 111 lock into recesses not shown in lower housing half 112.

The lock 110 is held in position on its associated case by a backing plate 118 that fits within the case, held in position by a plurality of fasteners 120 and 121 that extend through lower housing half apertures 124 and are threaded into apertures 125 in the upper housing half 113 to not only lock the entire lock assembly in position but also to lock the housing halves together in a tamper resistant fashion because fasteners 120 and 121 are inside the lock case.

Figure 19:
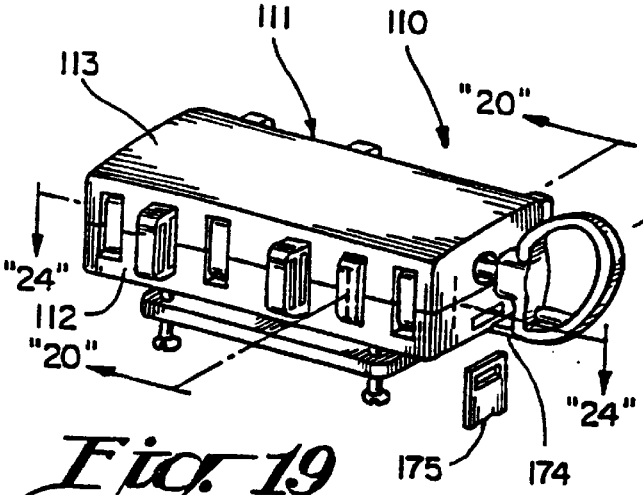
FIG. 19 is a perspective view of another embodiment of the present tamper resistant lock assembly.
Figure 22:
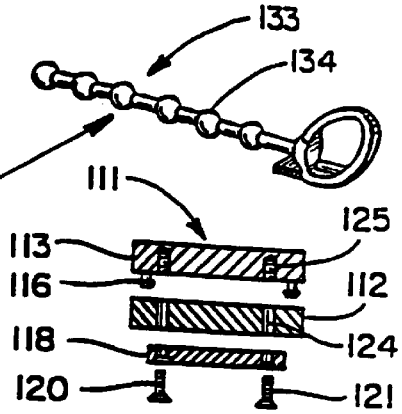
FIG. 22 is an exploded view of the tamper resistant lock assembly illustrated in FIG. 19.
Figure 20:
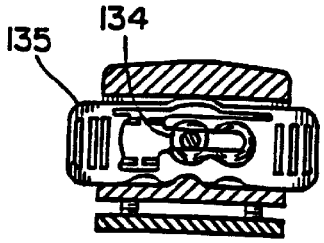
FIG. 20 is a cross-section taken generally along line 20—20 of FIG. 19 with a side pass slide therein.
Figure 21:
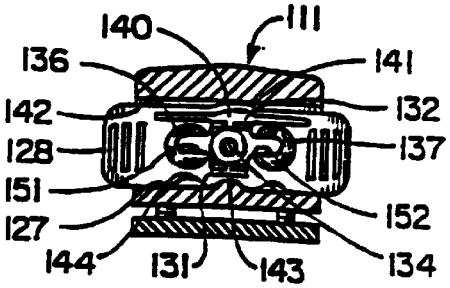
FIG. 21 is a cross-section generally similar to FIG. 20 with a central pass slide therein.

As seen in FIG. 21, which is an enlarged cross-section through FIG. 19, the housing 111 has through slots 127 that correspond with the slots in the FIGS. 1 to 17 embodiment, and each receive a central pass slide member 128, which function in a similar way to the slides shown in the FIGS. 1 to 17 embodiments. Slide 128 has a central aperture 131 having a diameter greater than the spheroidal blocking obstructions 134 on the plunger 133 to permit the plunger to be withdrawn when the slide 128 is in its central passing position. As in the FIGS. 1 to 17 embodiment, the passing aperture 131 is positioned in second slides 135 shown in FIG. 20, in one of the side apertures as opposed to the central aperture. The slide 128 has four flexible fingers 132 that are positioned on a diameter less than the diameter of spheroidal obstructions 134 to interfere with the obstructions 134 and function in the same way as fingers 60 and 61 illustrated in FIG. 5 to effect shifting of the slides 128 and 135 as the lock picker tugs on the plunger 133 to simulate a blocking position of the slides 128 and 135 when in fact they are in the passing position. Fingers 132 move radially with respect to the axis of the plunger 133 as opposed to the general axial bending movement of the fingers 60 and 61 in the FIG. 5 embodiment.

The two side positions of the slides 128 are defined by spheroidal recesses 136 and 137 that partly receive the end of the projections 134 to provide the snap action movement of the slides 128 when tension is applied to the plunger 133 in a manner similar to the FIGS. 1 to 17 embodiment. The depth of the recesses 136 and 137 is selected so that the plunger obstructions 134 engage the bottom of the recesses 136 and 137 with the same axial movement of the plunger 133 as when the plunger obstructions 134 engage the fingers 132.

The aperture 131 in FIG. 21 is contiguous with side slots 151 and 152 and they permit the slides to be shifted to their side positions aligning one of the spheroidal recesses 136 and 137 with the axis of plunger 133.

As with the FIGS. 1 to 17 embodiment, the snap action movement of the slide 128 to its three positions is achieved with tension being applied to the plunger 133 engaging the obstructions 134 in the recesses 136 and 137 or against the fingers 132, and as the slide 128 is shifted with that tension being applied, the user or lock picker can feel the snap action movement of the slides 128. The same is true of the slides 135.

According to the FIGS. 19 to 21 embodiment, means are provided to prevent the slides 128 and 135 from falling out of the housing 111 when the plunger 133 is completely withdrawn. Toward this end, a slot 140 is provided in the slides 128 and 135 that defines an upwardly arching integral leaf spring 141 that engages the upper surface 142 of slot 127 to continuously bias slides 128 and 135 downwardly toward the bottom of the slots 127. The bottom of each of the slots 127 has an axial projection 143 that selectively engages one of three recesses 144 to hold the slides in one of its three capable positions.

Figure 23:
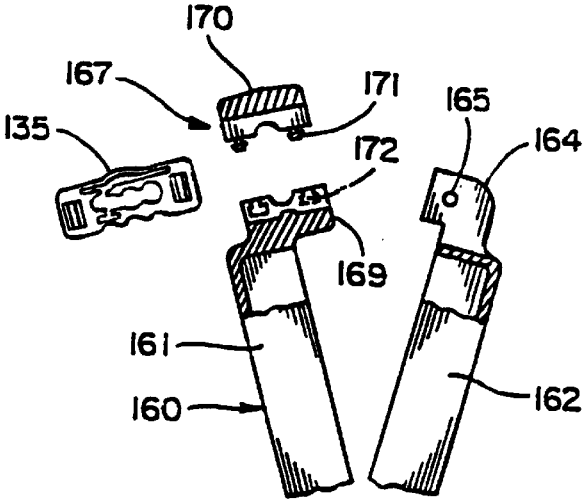
FIG. 23 is a partly fragmented section of a clamshell hard plastic case with the present tamper resistant lock assembly formed in part integrally therewith.
Figure 24:
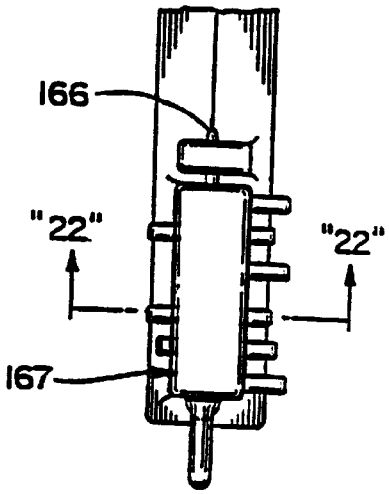
FIG. 24 is a top view of the tamper resistant lock assembly shown in FIG. 23.

In FIGS. 23 and 24, a clamshell-type rigid plastic case 160 is illustrated having case halves 161 and 162 that close together from the position shown in FIG. 23 to the top view closed position illustrated in FIG. 24. Case half 162 has an integral tang 164 with an aperture 165 therein, that receives a plunger 166 on lock assembly 167 that locks the case halves 161 and 162 together.

Lock assembly 167 consists of a lower housing half 169 that mates with an upper housing half 170 connected together by interlocking male and female projections 171 and 172. Housing halves 169 and 170 can also be connected together by tamper proof fasteners that extend from inside the case 160 in a similar fashion to fasteners 120 and 121 illustrated in FIG. 22. An important aspect of the lock 167 is that the lower housing half 169 is molded integrally with case half 161 providing not only an extremely low cost lock assembly, but one that is cosmetically attractive in the sense that it appears more integrated with the case 160.

We claim:

1. A tamper resistant combination lock for a container, comprising: a lock housing having a main passage there-through intersected by a plurality of cross slots, a plunger slidable in the main passage having a plurality of obstructions thereon, a plurality of generally planar blocking slides reciprocal in the cross slots having aperture means generally centrally there-through receiving the plunger movable to at least two indexible positions relative to the plunger, one in which the plunger obstructions are blocked by the slides substantially entirely around the aperture means and one in which the plunger obstructions may pass through the aperture means, said plunger being movable through the block slides in a direction perpendicular to the block slides, means to minimize lock picking including means on the slides engageable with the plunger obstructions when the slides are in the obstructions pass position that cause the slides to shift slightly in the housing slots as pressure is applied to the plunger, and means to prevent the slides from falling out of the housing with the plunger withdrawn including a spring detent assembly between the slides and the slots.

2. A tamper resistant combination lock for a container as defined in claim 1, wherein the spring detent assembly includes a slot in the slides that defines an integral leaf spring in the slides that biases the slides against one side of the slots.

3. A tamper resistant combination lock for a container as defined in claim 2, including a plurality of recesses on one side of the slides opposite the leaf spring and a cooperating projection in the slots selectively engageable in the recesses to hold the slides in its selective positions.

4. A combination lock, comprising: a lock housing having a main passage there-through intersected by a plurality of cross slots, a plunger slidable in the main passage having a plurality of obstructions thereon, a plurality of generally planar blocking slides reciprocal in the cross slots having aperture means generally centrally there-through receiving the plunger movable to at least two indexible positions relative to the plunger, one in which the plunger obstructions are blocked by slides and one in which the plunger obstructions may pass through the aperture means, said plunger being movable through the block slides in a direction perpendicular to the block slides, cooperating means on the slides and the plunger that provide snap action movement of the slides, and means to prevent the slides from falling out of the housing with the plunger withdrawn including a spring detent assembly between the slides and the slots.

5. A combination lock as defined in claim 4, wherein the spring detent assembly includes a slot in the slides that defines an integral leaf spring in the slides that biases the slides against one side of the slots.

6. A combination lock as defined in claim 5, including a plurality of recesses on one side of the slides opposite the leaf spring and a cooperating projection in the slots selectively engageable in the recesses to hold the slides in its selective positions.

* * * * *